US005123182A

United States Patent [19]

Hilgarth

[11] Patent Number: 5,123,182

[45] Date of Patent: Jun. 23, 1992

[54] DEVICE FOR THE OPERATION OF ADJUSTMENT, FASTENING OR THE LIKE ELEMENTS OF SKI SHOES AND SKI BINDINGS

[75] Inventor: Kurt Hilgarth, Graz, Austria

[73] Assignee: Dynafit Skischuh Gesellschaft m.b.H., Graz, Austria

[21] Appl. No.: 606,838

[22] Filed: Oct. 31, 1990

[30] Foreign Application Priority Data

Nov. 2, 1989 [AT] Austria ..... 2525/89

[51] Int. Cl.[5] ..... A43B 5/04; A43B 11/00

[52] U.S. Cl. ..... 36/117; 36/50; 36/113; 36/83

[58] Field of Search ..... 36/50, 117, 83, 113, 36/122, 118, 131, 58.5, 87

[56] References Cited

U.S. PATENT DOCUMENTS

| | | | |
|---|---|---|---|
| 1,778,413 | 10/1930 | Ballou | 36/58.5 |
| 1,978,711 | 10/1934 | Keely | 36/113 |
| 2,660,812 | 12/1953 | Henke | 36/117 |
| 3,187,073 | 6/1965 | Bingham, Jr. | 36/87 |
| 3,834,048 | 9/1974 | Maurer | 36/50 |
| 4,130,949 | 12/1978 | Seidel | 36/50 |
| 4,387,517 | 6/1983 | Annovi | 36/117 |
| 4,693,022 | 9/1987 | Terhune | 36/136 |
| 4,920,665 | 5/1990 | Pack et al. | 36/117 |

FOREIGN PATENT DOCUMENTS

| | | | |
|---|---|---|---|
| 1578913 | 5/1971 | Fed. Rep. of Germany . | |
| 2452304 | 5/1976 | Fed. Rep. of Germany . | |
| 2912946 | 10/1980 | Fed. Rep. of Germany . | |
| 81154 | 12/1952 | Norway | 36/117 |

*Primary Examiner*—Paul T. Sewell
*Assistant Examiner*—Marie Denise Patterson
*Attorney, Agent, or Firm*—Fleit, Jacobson, Cohn, Price, Holman & Stern

[57] ABSTRACT

A device for the operation of adjustment, fastening or the like elements of ski shoes and ski bindings comprises a small plate (5) adapted to be used as a screw driver, and which has been attached to a strap (3), belt or the like for the locking or holding together of the upper end of the ski shoe upper, for instance the collar (2).

6 Claims, 1 Drawing Sheet

DEVICE FOR THE OPERATION OF ADJUSTMENT, FASTENING OR THE LIKE ELEMENTS OF SKI SHOES AND SKI BINDINGS

FIELD OF THE INVENTION

The invention relates to a device for the operation of adjustment, fastening or the like elements of ski boots and ski bindings.

BACKGROUND OF THE INVENTION

For purposes of the tightening or loosening of adjustment or fastening elements of ski shoes or ski bindings, screw drivers, coins or plate-like tools are used, which are introduceable into the slots of screw heads, adjustment elements or the like. Such small tools are often supplied with the ski equipment and may be stored in a small pocket provided for this purpose in the ski shoe or else the skier must carry them on his person. All such devices have the disadvantage that they may be lost, that they may fall into the snow during use thereof, or that they may simply be forgotten to be taken along.

OBJECT AND SUMMARY OF THE INVENTION

The invention has an object to provide a remedy for this problem and proposes a device for the operation of adjustment, fastening or the like elements of ski shoes and ski bindings, whereby according to the invention, a tool for the operation of the said elements, for example, a small plate which can be used as a screw driver and which can be tucked into the shoe or the binding; a socket head key; a socket head screw or the like, has been mounted on a strap, a belt or the like serving for locking or the binding together of the upper end of the ski shoe upper or of the collar.

Preferably the tool, for example the small plate, is fitted, e.g. welded on to the free end of the strap, the belt or the like, by means of plastics material. This has the advantage, with the use of bur fastener strips, that frequently occurring fraying out of the end of the strap is prevented.

BRIEF DESCRIPTION OF THE DRAWINGS

In the drawing, a working example of the article according to the invention, is shown.

DETAILED DESCRIPTION OF THE DRAWINGS

Figure 1:
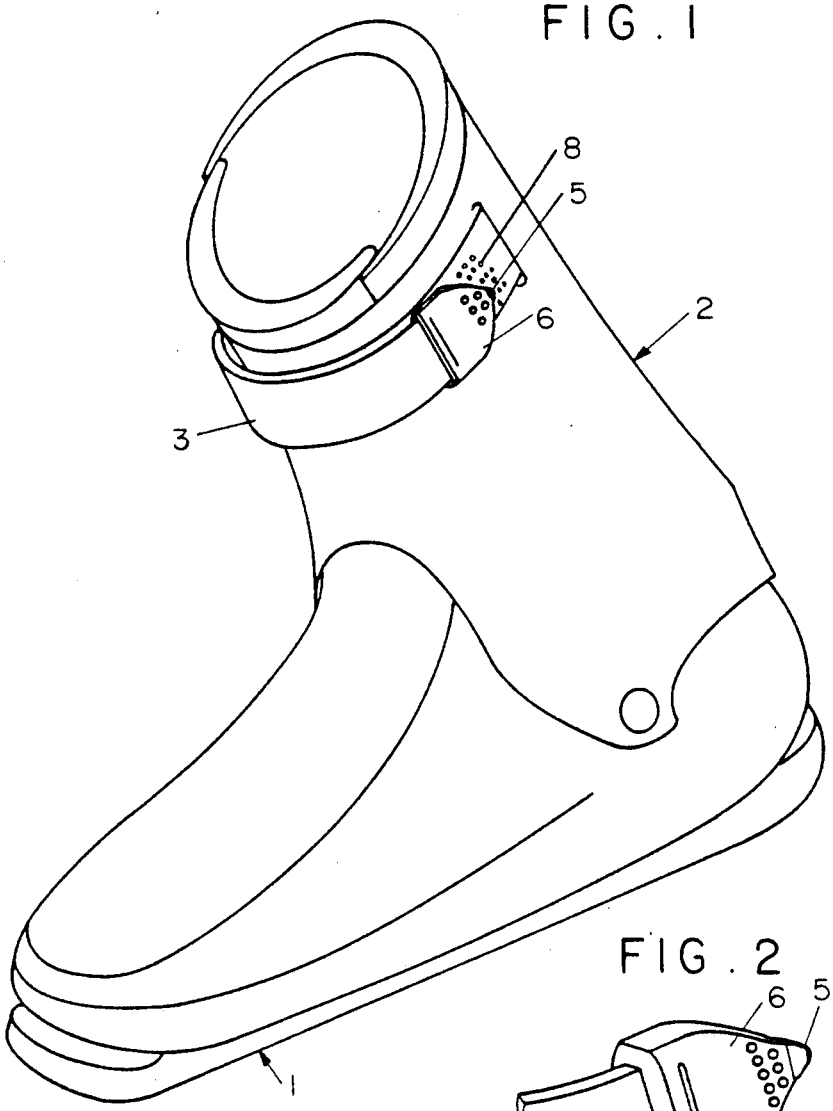
In FIG. 1, a side elevation of a ski boot comprising a device in accordance with the invention, is shown and in FIG. 2 an end piece of a strap with a small plate which had been welded on, is shown.
Figure 2:
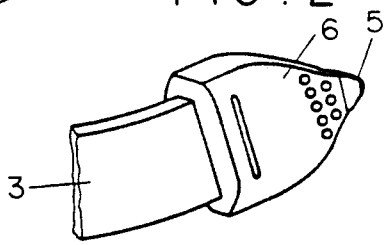
Figure 3:
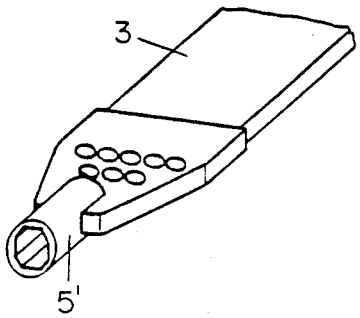
FIGS. 3 and 4 show alternative kinds of tools which can be used on the strap.
Figure 4:
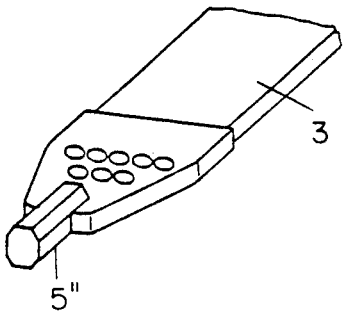

In FIG. 1, reference numeral 1 indicates a shell of a ski boot consisting of an inner and an outer shoe, the latter comprising a shell and a collar 2, articulated to the shell, whereby the collar 2 is open at the front and is lockable by means of a strap 3 with a loop and pile fastener. At the free end of the strap 3, a small plate 5 is provided which is formed such that it may be used as a screw driver. In the example under consideration, the small plate 5 has been fitted to the strap 3 by means of a plastic collar 6, which may be mounted by means of spray coating, molding, etc. The strap 3 is fastened to the outer shoe and in its open condition it is sufficiently long that the small plate 5 can be employed as a screw driver at any position on the shoe or on the binding in order to adjust screws.

It is to be understood that several constructive changes may be made within the scope of the invention. Thus, for example, instead of the small plate, a different tool, for instance a socket head key 5', a socket head screw 5'', a four-way socket wrench, or a similar tool may be used for the operation of adjustment, fastening or the like elements.

I claim:

1. A ski boot comprising a shell and a collar attached in an articulated manner to the shell, the collar having a front opening and a strap for releasably closing said opening wherein the strap has a free end provided with a tool thereon for manipulating screws on the ski boot and an associated binding, the tool being welded to the free end of the strap by plastic material and the strap being of sufficient length to enable the tool to reach said screws.

2. Ski boot according to claim 1, characterized in that the tool in form of a small plate has been fitted to the free end of the strap for use as a screw driver.

3. Ski boot according to claim 1, characterized in that the tool at the free end of the strap is shaped to form a socket head key.

4. Ski boot according to claim 1, characterized in that the tool at the free end of the strap is shaped to form a socket head screw.

5. Ski boot according to claim 1, characterized in that the tool has been fixed to a strap which is held by the collar of an outer shoe consisting of a collar and a shell.

6. Ski boot according to claim 1, characterized in that at its tool-bearing end the strap is fixed to the ski boot by a fastener.

* * * * *